United States Patent [19]

Mollard

[11] 4,396,003

[45] Aug. 2, 1983

[54] HEAT RECOVERY APPARATUS FOR INSTALLATION PARTICULARLY IN A DOMESTIC CHIMNEY, AND PROCESS FOR BRINGING A FLUID SUCH AS WATER TO A HIGHER TEMPERATURE

[76] Inventor: Pierre Mollard, 22 Rue des Grands Champs, 38230 Eybens, France

[21] Appl. No.: 214,618

[22] Filed: Dec. 9, 1980

[30] Foreign Application Priority Data

Oct. 12, 1979 [FR] France ..... 79 30256

[51] Int. Cl.[3] ..... F24B 7/00

[52] U.S. Cl. ..... 126/121; 126/132; 126/131

[58] Field of Search ..... 126/120, 121, 132, 131, 126/123, 126, 135, 136, 130; 237/51, 55

[56] References Cited

U.S. PATENT DOCUMENTS 2,075,161 3/1937 Baruch et al. ..... 126/132
2,622,587 12/1952 Dupler ..... 126/132
3,159,157 12/1964 Ponto ..... 126/121
3,169,516 2/1965 Agnese ..... 126/121
4,335,703 6/1982 Klank ..... 126/132

FOREIGN PATENT DOCUMENTS 76186 11/1947 Norway ..... 126/121

*Primary Examiner*—James C. Yeung
*Attorney, Agent, or Firm*—Beveridge, DeGrandi & Kline

[57] ABSTRACT

Heat recovery apparatus able to be installed, in particular, in a domestic chimney and able to provide hot air and hot water, comprising a horizontal lower chest 2 in which is formed a combustion chamber 12, a vertical chest 1 in which are disposed deflectors 27 and a horizontal upper chest 3, the air being heated during its passage through the vertical chest 1 and in the upper horizontal chest 3, and the water being heated during its passage in the neighborhood of the combustion chamber 12 and in the vertical chest.

13 Claims, 6 Drawing Figures

HEAT RECOVERY APPARATUS FOR INSTALLATION PARTICULARLY IN A DOMESTIC CHIMNEY, AND PROCESS FOR BRINGING A FLUID SUCH AS WATER TO A HIGHER TEMPERATURE

The present invention concerns a heat recovery apparatus intended to be installed particularly in a domestic chimney and able to provide both hot air for heating and also hot water for domestic uses or for heating.

The heat recovery apparatus according to the invention comprises, in particular, a chest which extends vertically and has at its lower part at least one opening, preferably for air to be heated, which can be regulated, and at its upper part at least one opening for escape of heated air, and a horizontal chest extending from the lower part of the said veritcal chest and having an upper surface which forms a hearth on which a fire can be made which heats the air circulating in the said vertical chest, the upper surface of the lower horizontal chest having an opening in which is disposed a grid for removal of ash to an ash-pan.

According to the present invention, the said horizontal chest has a combustion chamber into which can be introduced, via the said opening of the upper surface of the horizontal lower chest, a fuel such as coal. This combustion chamber is limited laterally by substantially vertical walls, at its upper part by the upper surface of the said horizontal lower chest, and at its lower part by a bottom provided with a grid for ash removal, the said grid of the upper surface of the horizontal lower chest being replaceable by a solid plate, and the smoke from the combustion chamber being removed via at least one smoke duct, the said chamber being usable to heat a fluid circulating in the neighborhood of, or within, the said chamber.

In a first variant of the invention, the heat recovery apparatus according to the present invention can be utilized to provide hot air and a fluid such as water to be heated.

For this purpose, at least one duct, having an inlet and an outlet and in which circulates a fluid such as water to be heated, preferably extends in the neighborhood of, or within, the said combustion chamber.

According to the present invention, the said horizontal lower chest can have a sealed chamber surrounding the said combustion chamber, and the said duct may be constituted in the form of a coil surrounding the said combustion chamber and disposed in the said sealed chamber.

According to the present invention, at least one duct, having an inlet and an outlet and in which a fluid such as water, can extend in the said vertical chest.

In order to restrain the ascent of air in the vertical chest of the heat recovery apparatus, deflectors can be disposed in this chest.

In a variant, the said duct extending in the vertical chest can extend between the said deflectors so that it substantially forms a coil.

In another variant, the said deflectors can be hollow and sealed and be mounted in series on the duct which extends in the vertical chest, such that the fluid circulating in this conduit circulates likewise in the hollow deflectors.

According to the present invention, the duct extending in the neighborhood of, or within, the combustion chamber and the duct extending within the vertical chest can advantageously be mounted in series.

According to the present invention, the said deflectors can extend transversely of the vertical chest and be constituted in a V shape with the point upwards, two adjacent deflectors being furthermore interconnectable by at least one supplementary duct.

In another variant of embodiment, the heat recovery apparatus according to the invention can be used solely to provide hot air.

For this purpose, the heat recovery apparatus according to the present invention can have at least one duct, having an inlet and an outlet and in which air can circulate to be heated, this duct extending in the neighborhood of, or within, the said combustion chamber.

According to the present invention, this duct can be constituted in the form of a sealed chamber surrounding the said combustion chamber, this sealed chamber having at least one opening for the admission of fresh air and at least one opening for the escape of heated air.

The said opening for the escape of heated air preferably opens into the said vertical chest, the said sealed chamber forming a substantially annular passage around the said combustion chamber and in which the air to be heated circulates. In this manner, the air heated about the combustion chamber can be introduced into the lower part of the vertical chest and this mix with the air circulating in this chest and removed at the upper part of this vertical chest.

According to the present invention, it is preferable to provide a fresh air duct with a variable throughput this duct opening under the lower grid of the combustion chamber so as to regulate the rate of combustion of the fuel disposed in the said chamber.

According to the present invention, the forward part of the vertical chest, facing the fire, can be partially constituted by a decorative cast iron plate which is removable for access to the interior of the vertical chest, and the upper face of the horizontal chest, as well as the walls of the said combustion chamber, can be of cast iron and likewise demountable.

In a simplified variant embodiment, the heat recovery apparatus according to the invention can have, in particular, a chest extending vertically and in front of which a fire can be set. This vertical chest can be provided at its lower part with at least one opening for admission of air to be heated, which can be controllable, and at its upper part with at least one opening for the escape of heated air. In order to heat a fluid such as water, at least one duct can be provided, having an inlet and an outlet and in which the said fluid can circulate, this duct extending in the said vertical chest. This duct can advantageously take the form of a coil, and the vertical chest can have, internally, deflectors restraining the ascent of air and with the coil extending between them.

The present invention likewise concerns a process for bringing a fluid such as water or air to a higher temperature. This process is such that the said fluid is caused to circulate in the neighborhood of, or within, the combustion chamber, which can receive a fuel such as coal, of a heat recovery apparatus installed in a domestic chimney and in particular having a horizontal lower chest in which the said combustion chamber is formed.

According to the process of the invention, the heat recovery apparatus furthermore comprises a vertical chest in which can circulate air which is heated, in particular when a fire is set on the said horizontal chest, the said fluid can likewise be circulated in this vertical chest.

Thus the fluid can be circulated in the vertical chest such that the air is heated, particularly in the case in which only the said combustion chamber is used, the said fluid being previously heated in the neighborhood of the combustion chamber. The fluid circulating in the vertical chest can likewise be heated, in particular due to the flow of hot air rising in this chest.

According to the process of the present invention, the said fluid can circulate in the vertical chest within deflectors which can restrain the ascent of air within the chest.

According to the present invention, it is possible to associated a solar heat collector, in which the said fluid will likewise circulate, with the heat recovery apparatus.

The heat recovery apparatus according to the present invention will be better understood on study of three variant embodiments, which are described by way of non-limiting example and illustrated by the drawing, in which.

Figure 1:
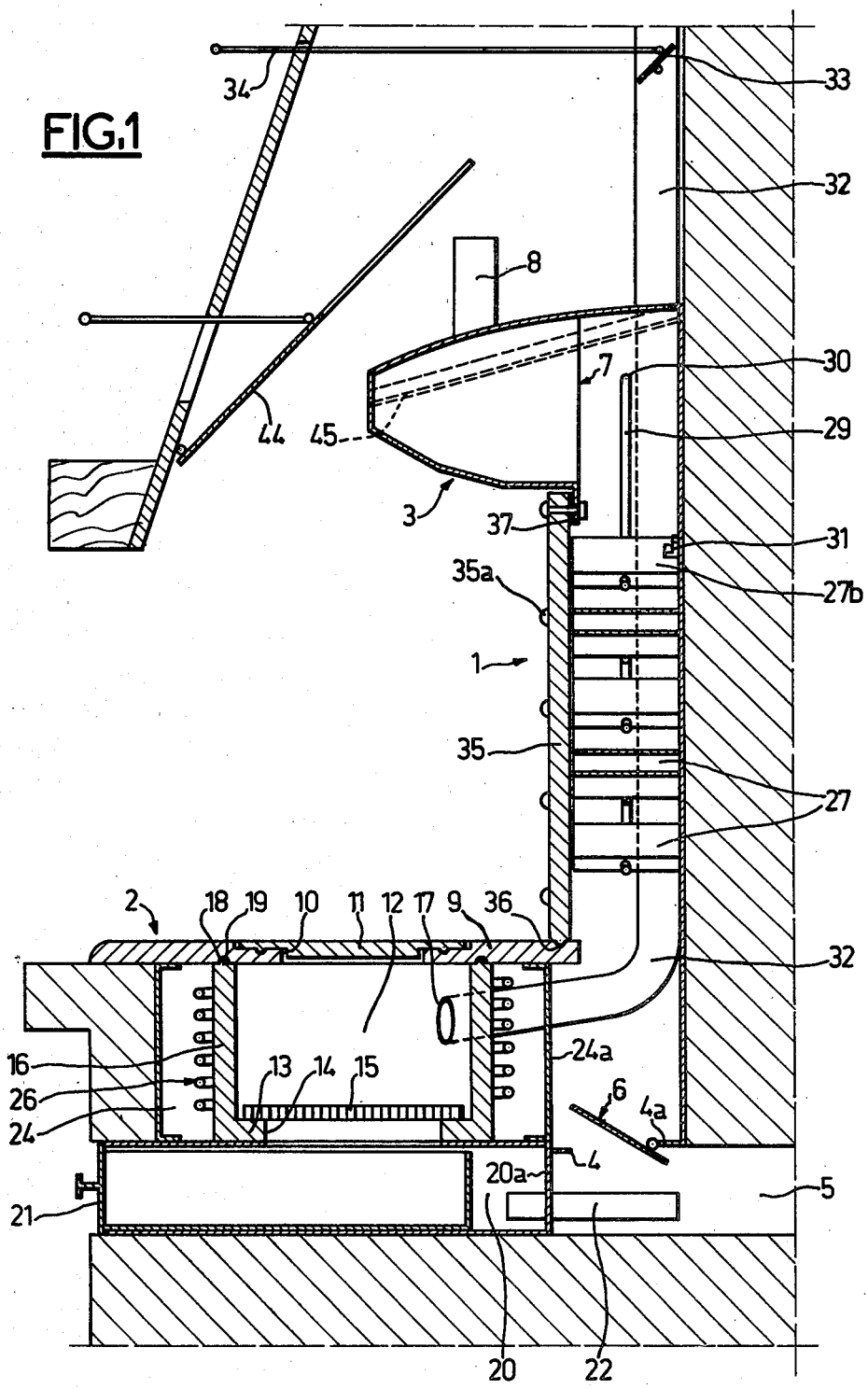
FIG. 1 shows a heat recovery apparatus installed in a domestic chimney and able to supply hot air and hot water, in vertical section.
Figure 2:
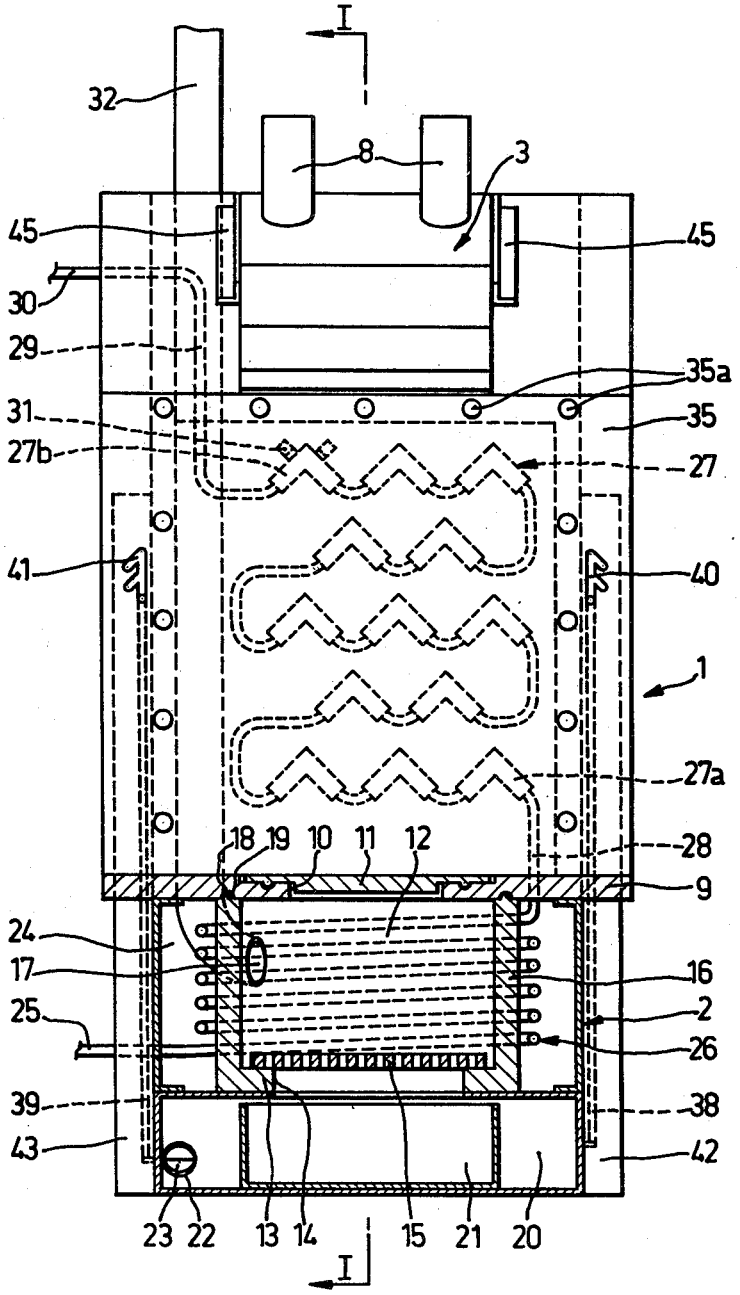
FIG. 2 shows a front view of the heat recovery apparatus according to FIG. 1, the lower part being in section.
Figure 3:
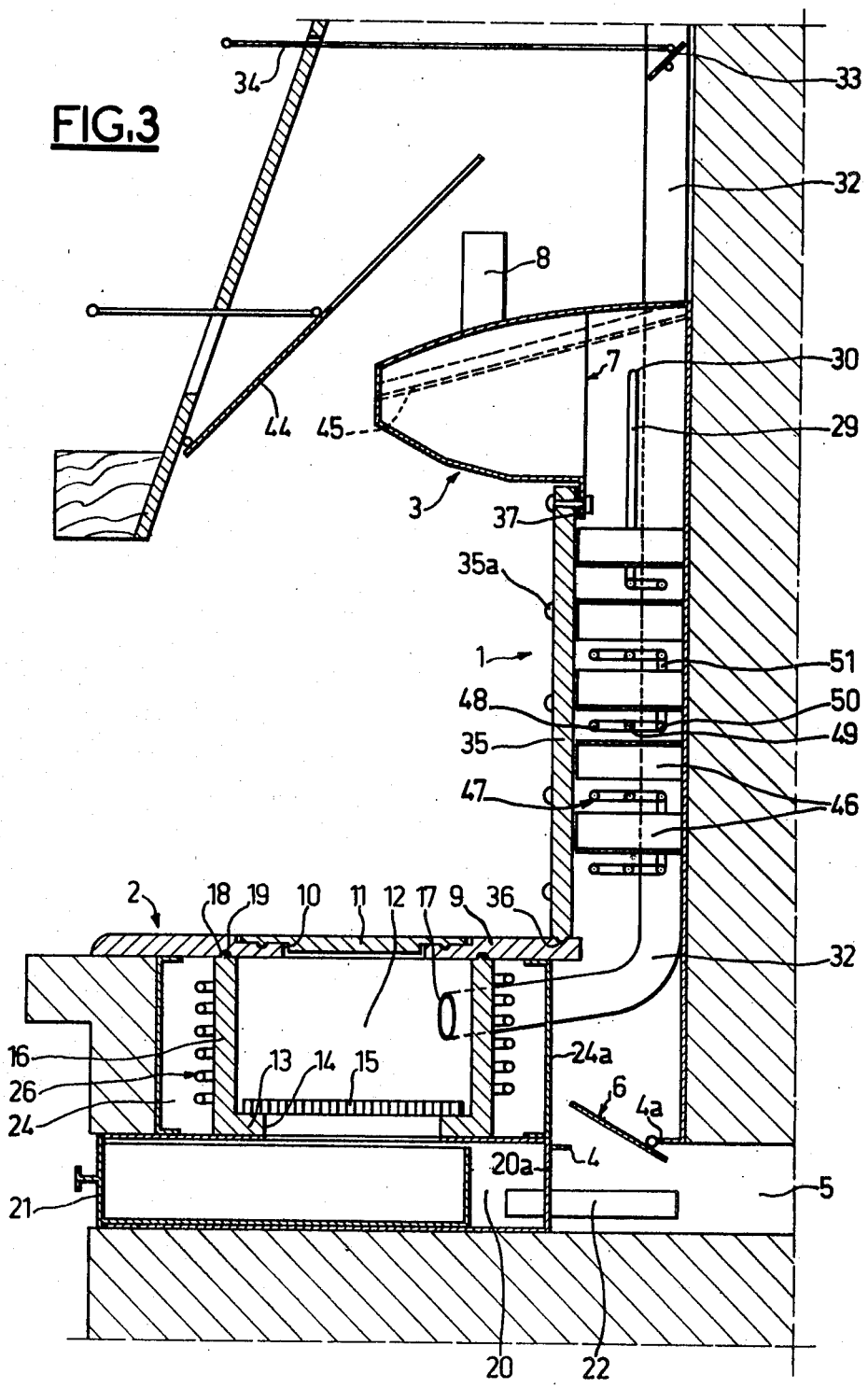
Figure 4:
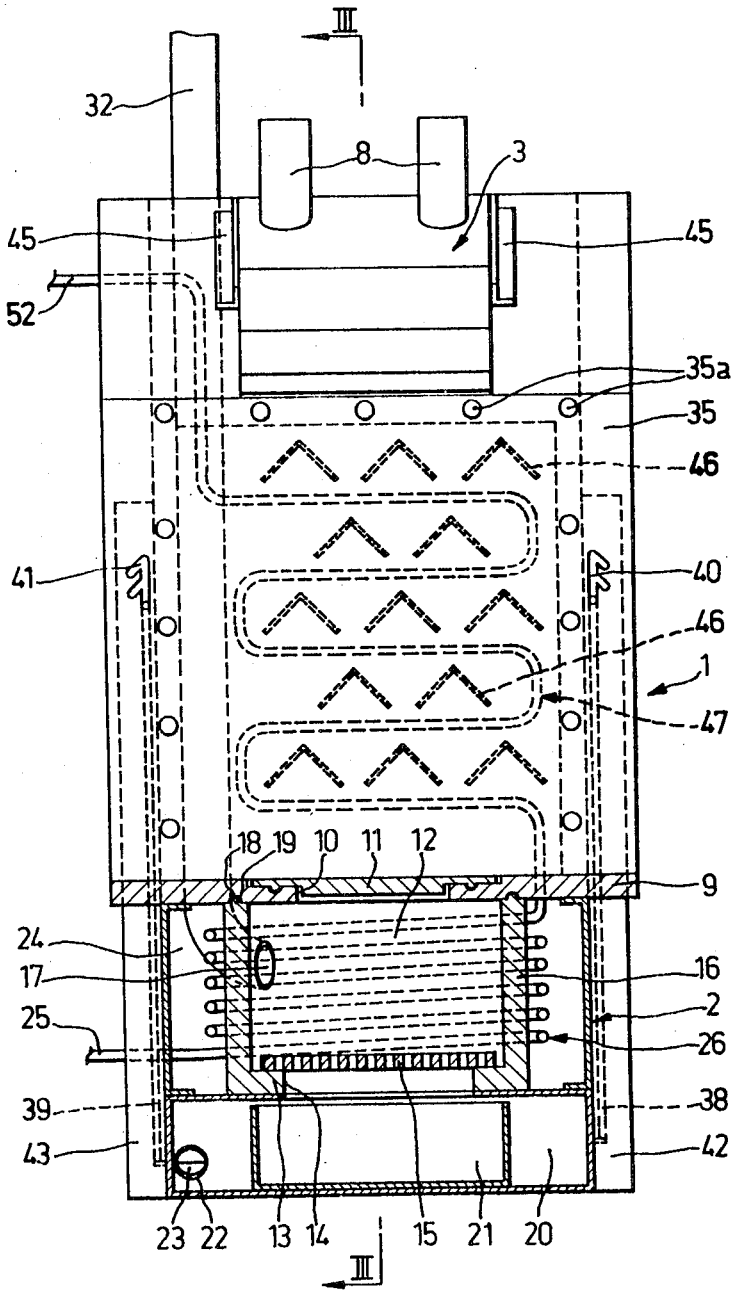
Figure 5:
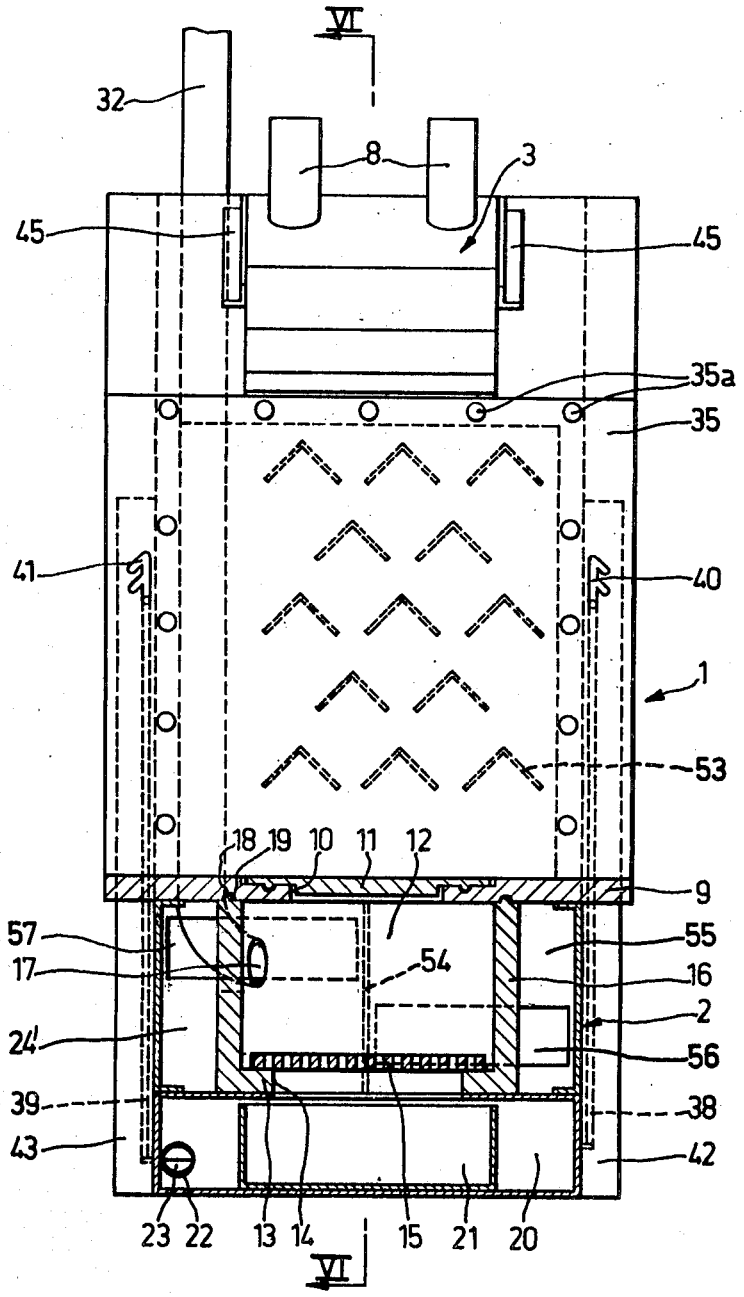
Figure 6:
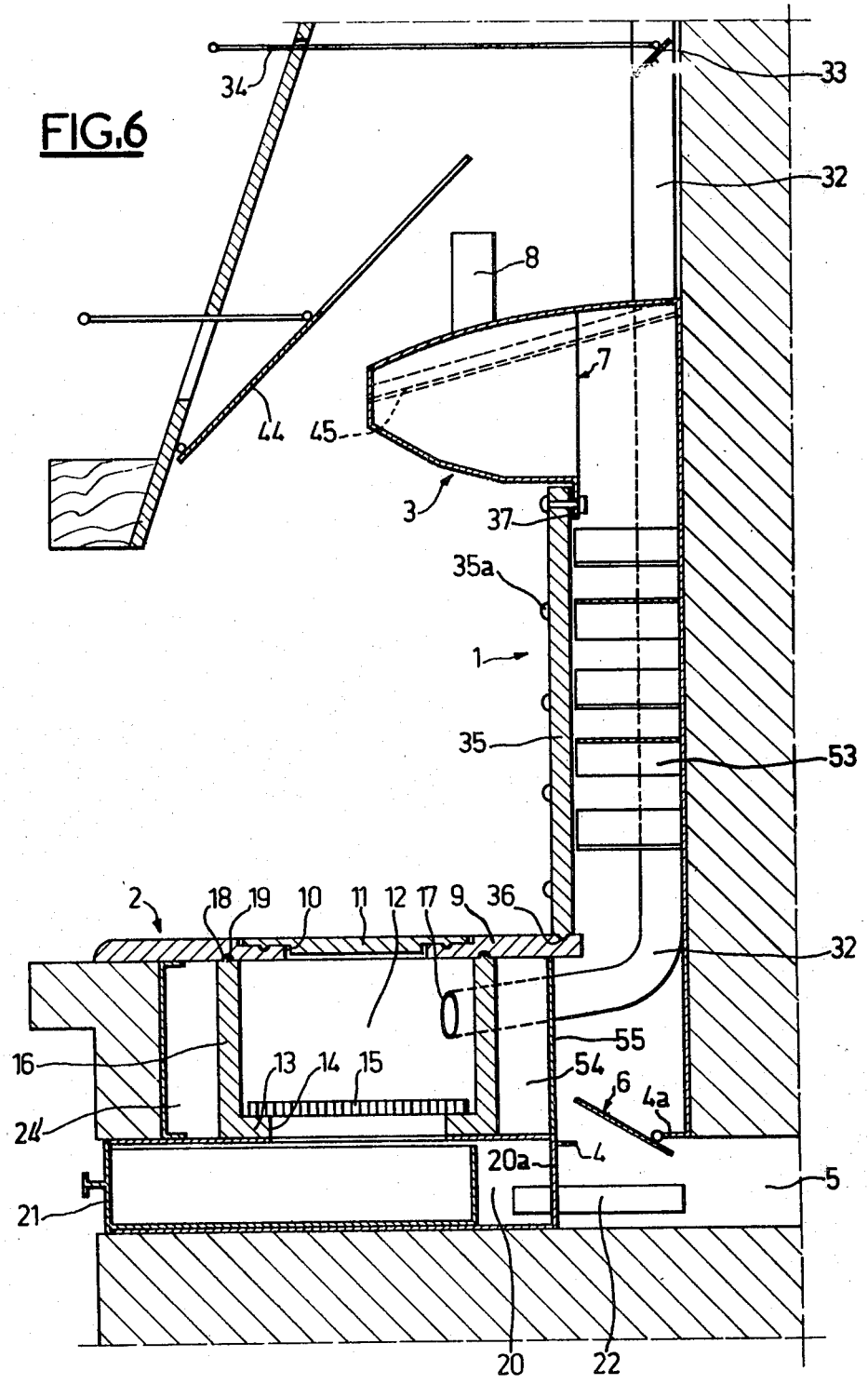

FIGS. 3 and 4 show a variant of the heat recovery apparatus shown in FIGS. 1 and 2, in corresponding views; and FIGS. 5 and 6 show, in views corresponding to FIGS. 1 and 2, a heat recovery apparatus able to supply hot air only.

It will firstly be noted that the three heat recovery apparatuses shown have, in a general way, the same structure. This is why the constructional elements which are found in each of these heat recovery apparatuses will be given the same reference and will only be described once.

The heat recovery apparatus shown in FIGS. 1 and 2 comprises a vertical chest, generally designated 1, a horizontal chest extending from the lower part of the vertical chest 1, and generally designated 2, and a decompression chest extending from the upper part of the vertical chest 1 and generally designated 3; the vertical chest 1 is built into the bottom wall of the chimney, and the horizontal lower chest in its hearth.

Vertical chest 1, which has a substantially rectangular horizontal section, has an opening 4 at its lower part, permitting admission of fresh air into the vertical chest from a passage 5 formed in the wall of the chimney. The throughput of air entering the chest 1 via the opening 4 can be regulated by the flap valve 6, which can obstruct the opening 4 to a greater or lesser degree and can completely close it. It can be remarked that the passage 5 which is shown horizontal in the example could equally well be disposed vertically and communicate, for example, with a cellar.

The upper part of the vertical chest 1 communicates via an opening 7 with the horizontal chest 3, which has on its upper part, in the example shown, two apertures 8 for escape of air.

When a fire has been set on the lower horizontal chest 2, the air in vertical chest 1 and in the horizontal upper chest 3 is heated and circulates from opening 4 of the vertical chest 1 as far as the exit apertures 8 of the upper horizontal chest, to be distributed to the room or rooms to be heated.

The lower horizontal chest 2 comprises a substantially horizontal plate 9 forming the upper face of chest 2, on which a fire can be set.

This plate 9 has, substantially centrally, a cylindrical opening 10 which can receive a cover 11. This cover can be constituted as a grid for downward removal of ashes from the fire set on plate 9.

The horizontal lower chest 2 has a combustion chamber 12 into which a fuel such as coal can be introduced via the opening 10 of the plate 9 and which is limited at its lower part by a bottom having an opening 14 closed by a grid 15 for removal of ash and laterally by a vertical wall 16 which is shown as cylindrical in the example, the bottom 13 being of one piece with said wall 16. The cylindrical wall 16 has an opening 17 in the neighborhood of its upper part for removal of smoke. When a fuel is burnt in the chamber 12, a cover 11 can advantageously be provided, constituted in the form of a solid plate.

The lower surface of the plate 9 has an annular groove 18 into which penetrates an annular projection 19 provided at the upper part of the said wall 16, an asbestos gasket being disposed at the bottom of the groove 18 so as to create a connection which is sealed to smoke.

The horizontal lower chest 2 likewise has a part in the form of a chest 20 located below the combustion chamber 12 and in which is disposed a removable drawer 21 to receive ash which can come from the combustion chamber or from above the plate 9, passing via the combustion chamber 12.

A duct 22 passing through the rear wall **20*a* of the chest 20 enables the passage 5 to be placed in communication with this chest 20 so as to provide fresh air under the combustion chamber 12. As can be seen in FIG. 2, duct 22 is furnished with a regulatable flap valve 23 enabling the rate of combustion to be regulated, in particular in the combustion chamber 12**.

The horizontal lower chest 2 furthermore, has a sealed chamber 24 surrounding the cylindrical wall 16 of the combustion chamber 12. This sealed chamber 24 is delimited at its lower part by the upper wall of chamber 20, at its upper part by the plate 9, and laterally by vertical walls situated at a distance from the wall 16 of the combustion chamber 12, and in particular by a rear wall **24*a* extending the rear wall 20*a* of the chamber 20 and separating the sealed chamber 24 from the interior of the vertical chest 1. It can be remarked that the horizontal lower wall 4*a* in which the opening 4 is made is substantially in alignment with the wall separating chamber 20 from chamber 24, the flap valve 6 opening within the vertical chest and the channel 5 being substantially in alignment with the chamber 20**.

A duct, in which a fluid such as water can circulate, and which has one end 25 opening laterally to the exterior of the horizontal lower chest 2, is formed as a coil 26 surrounding the cylindrical wall 16 of the combustion chamber 12 and disposed in the sealed chamber 24.

As can be seen in particular in FIG. 2, in dotted line, a series of deflectors 27 is disposed in the vertical chest 1. These deflectors 27 extend, horizontally, transversely of the chest 1 and are disposed in alignment in horizontal and vertical rows such that the deflectors of two adjacent horizontal rows are staggered relative to each other. These deflectors are of a V shape with the point directed upwards.

The deflectors 27 are hollow and are connected together in series from the first deflector 27*a* of the lower row to the last deflector 27*b* of the upper row, the free ends of the branches of one deflector being connected by a duct to the free ends of the adjacent deflectors. It can be noted that the said ends could be connected by several ducts. Moreover, the coil 26 is extended by a duct 28 opposite to its end 25, this duct connecting coil 26 to the free end of the first deflector 27*a* of the said series of deflectors. Furthermore, a duct 29 has one of its ends connected to the free end of the last deflector 27*b* of its said series of deflectors, its other end 30 opening laterally to the vertical chest 1. The deflectors 27 are fixed on the rear face of the vertical chest 1 and do not extend as far as its front face, so as to permit expansion due to temperature variations. The deflectors 27 can be connected to the rear surface of the chest 1, for example, by welded lugs 31, in the example, of deflector 27*b*.

It is thus possible to cause a fluid such as water to circulate in the coil 26 around the combustion chamber 12 and in the series of deflectors 27 disposed in the vertical chest 1 between the end 25 of the coil 26 and the end 30 of the duct 29, equally well in either direction.

The combustion chamber 12 communicates with a smoke duct 32 via the said opening 17. This smoke duct 32 passes through the rear wall 24*a* of the sealed chamber 24, then extends substantially vertically within the vertical chest 1 and opens above this vertical chest to discharge the smoke within the chimney, and at the same time to heat the air circulating in the vertical chest. In the neighborhood of its upper part, the smoke duct 32 is provided with a flap valve 33 that can be actuated by a rod 34 extending through the front wall of the duct of the chimney, this flap valve 33 acting to regulate the throughput of smoke derived from the combustion chamber 12.

The front face of the vertical chest 1 is partially constituted by a decorative plate 35 extending below the upper vertical chest 3 as far as the horizontal plate 8 and permitting access to the interior of the vertical chest 1. The lower edge of the plate 28 rests, sealed by a gasket 36, on the horizontal plate 9 and the three other sides of the plate 28 are sealingly fixed by a gasket 37 to the other parts of the vertical chest 1 by bolts 35*a*. Thus the vertical wall 16 and the bottom 13, the plate 9 and also the plate 35, which are perferable of cast iron, are removable.

The flap valves 6 and 23 are regulatable by rods 38 and 39 extending vertically behind plate 35 outside chest 1 and laterally, and extended horizontally forwards through orifices in the form of toothed racks 40 and 41 enabling the said flap valves to be regulated. Furthermore, the rods 38 and 39 are disposed in housings 42 and 43.

With reference to FIG. 1, it can be seen that the duct of the chimney can be blocked by a pivoting plate 44 which can rest on angle irons fixed laterally and at either side of the upper horizontal chest 3.

The principal uses of the heat recovery apparatus shown in FIGS. 1 and 2 will now be described.

Firstly, if a fire is made on the plate 9 of the lower horizontal chest 2, hot air can be recovered at the exit of the aperatures 8, and the throughput of this air can be controlled by the flap valve 6. Water circulating in the coil 26 and in the series of deflectors 27 can likewise be heated, the water being essentially heated during its passage through the deflectors 27.

If a fuel is burned in the combustion chamber 12, hot air can be obtained at the exit of the apertures 8, this air being heated by means of the heat which is present between the horizontal lower chest 2 and the horizontal upper chest 3 and by means of the smoke duct 32. Hot water can likewise be obtained by circulating water, preferably first in the deflectors 27 and then in the coil 26. If water is first circulated in the coil 26 and then into the deflectors 27, a heat exchange will occur between the air circulating in the vertical chest 1 and in the deflectors 27. In this direction of circulation of water, the air will likewise be heated by deflectors 27. The loss of heat by the water in the deflectors 27 will depend on its throughput and on the throughput of air in the vertical chest 1.

When only the combustion chamber 12 is utilized, it is preferable to close the duct of the chimney with the plate 44, so as not to permit escape of the heat passing particularly through the upper face of the horizontal lower chest 2, in order to recover this heat both in the vertical chest 1 and in the horizontal upper chest 3 and also in the room in which the chimney furnished with the heat recovery apparatus is located.

In a general manner, it can be noted that the temperature differences between the inlet and the outlet will depend, both for the water and for the air, on the throughputs and also on the temperature of the fires.

The water circulating in the heat recovery apparatus as described with reference to FIGS. 1 and 2 can be utilized for any useful purpose. This heated water can be utilized particularly for the heating of water contained in a hot water reservoir, the water of this reservoir being usable for domestic purposes or for heating, for example, by radiators. The water passing through the heat recovery apparatus can likewise circulate directly into heating radiators. Furthermore, any other heating apparatus, such as solar collectors, can be associated with the heat recovery apparatus which has been described. Many other utilizations are likewise possible in association with known apparatuses.

FIGS. 3 and 4 show a variant of the heat recovery apparatus shown in FIGS. 1 and 2 its operation and its utilization correspond to the recovery apparatus already described. Apart from the above differences, the heat recovery apparatus shown in FIGS. 3 and 4 has a structure similar to that of the heat recovery apparatus of FIGS. 1 and 2. For this reason the analogous elements bear the same reference numbers and will not be described once more.

In this embodiment, the deflectors 46 are no longer hollow but are formed, for example, by metal sheets which are constituted in a V-shape with the point directed upwards, these deflectors acting to restrain the ascent of air in the vertical chest 1.

In the example shown, deflectors have been disposed in five horizontal lines and five columns, two horizontal rows of deflectors producing a free horizontal space between them. The deflectors 46 are fixed, in the example shown, to the rear wall of the vertical chest 1.

In the variant shown in FIGS. 3 and 4, the duct forming the coil 26 is extended by a duct 47 which extends in the vertical chest 1 between the deflectors 46.

As can be seen in particular in FIG. 3, the duct 47 is constituted, in the vertical chest 1, in the form of a coil which has, below each horizontal row of deflectors 46, a horizonal layer with three branches 48, 49, and 50, two adjacent horizontal layers being connected together by a vertical branch 51. In the example shown, the duct 47 is constituted in the form of a coil with five horizontal layers. Following this coil, the duct 47 is prolonged and extends laterally to the exterior of the vertical chest 1, where it has an end 52.

As the duct 47 extends for a considerable length within the vertical chest 1 in the form of a coil, the heat exchange between the water circulating in this duct 47 and the air circulating vertically in the vertical chest 1 is excellent, and this exchange can occur in one direction or the other.

The form of the duct 47 within the vertical chest 1 is not limited to the example shown. This duct 47 can in fact be constituted in a completely different shape and the position of the deflectors 46 is not limitative.

With reference to FIGS. 5 and 6, a heat recovery apparatus able to provide only hot air will now be described.

This heat recovery apparatus is close, overall, to the heat recovery apparatus shown in FIGS. 3 and 4, and has deflectors 53 placed in the same manner as the deflectors 46 of the heat recovery apparatus shown in FIGS. 3 and 4. However, this heat recovery apparatus no longer has ducts in which water can circulate.

The sealed chamber 24' of the collector shown in FIGS. 5 and 6, surrounding the cylindrical wall 16 of the combustion chamber 12 disposed in the horizontal lower chest 2, has a vertical lower partition 54 disposed substantially in the plane of symmetry of the collector; this partition 54 connects the wall 16 of the sealed chamber 24', which corresponds to the rear wall 20a of the heat recovery apparatuses already described.

On one side of the partition 54, the rear wall 55 has, in its lower part, an opening 56 establishing a communication between the interior of the vertical chest 1 and the interior of the sealed chamber 24', and it has, on the other side of the partition 54, in its upper part, an opening 57 which likewise establishes a communication between the interior of the vertical chest 1 and the interior of the sealed chamber 24', the smoke duct 32 passing through this opening 57.

There is thus obtained around the combustion chamber 12 a substantially annular corridor having an inlet opening and an outlet opening for the air.

The operation of the heat recovery apparatus shown in FIGS. 5 and 6 will now be described.

When flap valve 6 is open, the air coming from passage 5 rises in the vertical chest 1 as has been previously described. Furthermore, a part of the air penetrating into the vertical chest via its lower opening 4 can penetrate to the interior of the sealed chamber 24 via its opening 56 and, after having gone around the combustion chamber 12, can leave it via its opening 57 and then continue its path in the vertical chest 1. Because of its orientation, the valve 6 advantageously plays the part of a deflector and enables air to be deviated in the direction of the opening 56 of the sealed chamber 24'.

When a fire is set only on plate 9, the air circulating in the heat recovery apparatus will essentially be heated in the vertical chest 1. However, when only the combustion chamber 12 is used, the air penetrating into the heat recovery apparatus via the lower opening 4 of the vertical chest 1 will essentially be heated during its passage into the sealed chamber 24, and it is essentially this heated air which will create a rising circulation in the vertical chest 1.

As in the preceding examples, the heat collector shown in FIGS. 5 and 6, and intended solely to provide hot air, can operate for a relatively long time without attention; this independence depending on the volume of the combustion chamber 12 which can receive a fuel such as coal.

The present invention is not limited to the examples described above. In fact, the circulation of water or of air in the vertical wall 16 of the combustion chamber can be envisaged. Furthermore, several smoke ducts 32 passing through the vertical chest 1 can be provided, or also a vertical duct occupying the whole width of the vertical chest 1 so as to obtain a greater contact surface with the air passing through the vertical chest 1. Ducts can likewise be provided, in which water is circulated, in several parts to facilitate mounting of them. The annular corridor in which air to be heated circulates around the combustion chamber 12 can furthermore be arranged in a completely different manner, forming, for example, two directions of circulation. Finally, the ducts for water could likewise be integrated with the walls of the chests. Many other variants are obviously possible without departing from the spirit of the present invention.

I claim:

1. Heat recovery apparatus intended to be installed in a domestic chimney and adapted to burn a fuel for heating air and a fluid, comprising:

a vertical chest provided at its lower part with at least one opening for admission of air and at its upper part with at least one opening for escape of air;

a horizontal chest extending from the lower part of said vertical chest, the upper surface of said horizontal chest forming a hearth;

a combustion chamber formed in said horizontal chest and provided with an air inlet duct and a smoke duct; and at least one duct extending in the neighborhood of said combustion chamber for circulating of said fluid, said combustion chamber being limited laterally by substantially vertical walls, at its lower part by a bottom provided with a grid and at its upper part by said upper surface of said horizontal chest provided with an opening whereby said opening can be provided with a grid for permitting escape of ash therethrough and through said combustion chamber and said bottom grid when a fire is desired on said upper surface or with a solid plate when a fire is desired in said combustion chamber or on said upper surface.

2. Heat recovery apparatus according to claim 1 wherein said horizontal chest has a sealed chamber surrounding said combustion chamber, said duct being constituted in the form of a coil surrounding the combustion chamber and disposed in the sealed chamber.

3. Heat recovery apparatus according to claim 1 wherein said duct extends also within said vertical chest.

4. Heat recovery apparatus according to claim 3 wherein deflectors are provided within said vertical chest, said duct extending between said deflectors to sustantially form a coil.

5. Heat recovery apparatus according to claim 3 wherein hollow and sealed deflectors are provided within said vertical chest and are mounted in series on said duct, whereby circulation of said fluid in said duct and in said deflector is permitted.

6. Heat recovery apparatus according to claim 1 wherein said smoke duct extends within said vertical chest.

7. Heat recovery apparatus according to claim 1 wherein said horizontal chest is provided with a removable ash drawer placed under the bottom grid of said combustion chamber.

8. Heat recovery apparatus intended to be installed in a domestic chimney and adapted to burn a fuel for heating air comprising:

a vertical chest provided at its upper part with at least one opening for escape of air;

a horizontal chest extending from the lower part of said vertical chest, the upper surface of said horizontal chest forming a hearth;

a combustion chamber formed in said horizontal chest and provided with an air inlet duct and a smoke duct, said combustion chamber being limited laterally by substantially vertical walls, at its lower part by a bottom provided with a grid and at its upper part by said upper surface of said horizontal chest provided with an opening; and an air duct extending in the neighborhood of said combustion chamber and provided with at least one opening for admission of air and at least one opening for communication with the lower part of said vertical chest, said opening in the upper surface of said horizontal chest being provided with a grid for permitting escape of ash therethrough and through said combustion chamber and said bottom grid when a fire is desired on said upper surface or with a solid plate when a fire is desired in said combustion chamber or on said upper surface.

9. Heat recovery apparatus according to claim 8 wherein said air duct is constituted in the form of a sealed chamber surrounding said combustion chamber.

10. Heat recovery apparatus according to claim 9 wherein said sealed chamber forms a substantially annular corridor around said combustion chamber.

11. Heat recovery apparatus according to claim 8 wherein said vertical chest is provided at its lower part with an opening for admission of air.

12. Heat recovery apparatus according to claim 8 wherein said smoke duct extends within said vertical chest.

13. Heat recovery apparatus according to claim 8 wherein said horizontal chest is provided with a removable ash drawer placed under the bottom grid of said combustion chamber.

* * * * *